US009248696B2

(12) United States Patent
Maria et al.

(10) Patent No.: US 9,248,696 B2
(45) Date of Patent: Feb. 2, 2016

(54) SHADOW SKULL MOUNTING APPARATUS

(71) Applicants: Darren Maria, Factoryville, PA (US); Keith Jennings, Dimock, PA (US)

(72) Inventors: Darren Maria, Factoryville, PA (US); Keith Jennings, Dimock, PA (US)

(73) Assignee: Northeast Machinery Network, Inc., Factoryville, PA (US)

( * ) Notice: Subject to any disclaimer, the term of this patent is extended or adjusted under 35 U.S.C. 154(b) by 0 days.

(21) Appl. No.: 14/162,851

(22) Filed: Jan. 24, 2014

(65) Prior Publication Data

US 2014/0209768 A1 Jul. 31, 2014

Related U.S. Application Data

(60) Provisional application No. 61/758,874, filed on Jan. 31, 2013.

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 3/00*** | (2006.01) |
| ***E04H 5/06*** | (2006.01) |
| ***F21V 21/00*** | (2006.01) |
| ***F21V 35/00*** | (2006.01) |
| ***B44C 5/02*** | (2006.01) |
| *A47G 29/02* | (2006.01) |
| *E04G 3/20* | (2006.01) |
| *E06B 7/28* | (2006.01) |
| *A47F 7/06* | (2006.01) |
| *A47G 25/10* | (2006.01) |
| *A47F 5/00* | (2006.01) |
| *A47G 35/00* | (2006.01) |
| *G09F 19/00* | (2006.01) |

(52) U.S. Cl.

CPC ... *B44C 5/02* (2013.01); *A47F 5/00* (2013.01); *G09F 19/00* (2013.01)

(58) Field of Classification Search

CPC ..... A47G 1/12; B44C 5/02; A47B 96/061; A47B 96/06; A47B 96/027; A47B 57/567; A47B 1/2608

USPC ..... 248/235, 250, 346.03, 220.21, 220.22, 248/240, 240.3, 240.4, 247, 248; 211/87.01, 106.01, 119.004

See application file for complete search history.

(56) References Cited

U.S. PATENT DOCUMENTS

| | | | | | |
|---|---|---|---|---|---|
| 1,039,692 | A | * | 10/1912 | Buffinger et al. | 248/248 |
| 3,097,822 | A | * | 7/1963 | Attwood | 248/250 |
| 4,464,440 | A | | 8/1984 | Dotzman | |
| 4,659,044 | A | * | 4/1987 | Armstrong | 248/218.4 |
| D296,677 | S | * | 7/1988 | Trueax | D11/134 |

(Continued)

*Primary Examiner* — Syed A Islam
*Assistant Examiner* — Taylor Morris
(74) *Attorney, Agent, or Firm* — Martin R. Misiura, Esq.

(57) ABSTRACT

A European mount for display of an animal skull and any attached features comprising a skull mounting bracket utilizing a single support prong with incorporated stabilizing wings sized to fit within the foramen magnum to hold the skull in a natural, upright position while allowing for easy placement and removal of the skull, fastened to a customizable base support plate modeled after the natural features of the animal. The skull mounting bracket has a planar end opposing the support prong for mounting to the support plate. When an animal skull is mounted and the present embodiment of the invention is affixed to a vertical surface, the support plate will line up with the features on the animal skull such that said support plate will appear as a shadow cast by the mounted animal on the vertical surface.

3 Claims, 9 Drawing Sheets

(56) References Cited

U.S. PATENT DOCUMENTS

| | | | | | |
|---|---|---|---|---|---|
| 4,971,865 | A * | 11/1990 | Nowlan | 428/542.4 |
| D407,993 | S * | 4/1999 | Sprinkle | D11/134 |
| 7,472,876 | B2 * | 1/2009 | Jones | 248/242 |
| D611,875 | S | 3/2010 | Walker | |
| 7,744,052 | B2 * | 6/2010 | Wooten | 248/248 |
| 8,201,793 | B1 | 6/2012 | Powell | |
| 8,459,601 | B2 | 6/2013 | Shaw | |
| 2006/0154224 | A1 * | 7/2006 | St. Ama | 434/296 |
| 2010/0126803 | A1 * | 5/2010 | Cama | 182/187 |
| 2011/0036959 | A1 * | 2/2011 | Raby | 248/282.1 |
| 2012/0219731 | A1 | 8/2012 | Paragamian | |

* cited by examiner

SHADOW SKULL MOUNTING APPARATUS

CROSS REFERENCE TO RELATED APPLICATION(S)

This application claims priority to Provisional Patent Application 61/758,874 filed on Jan. 31, 2013.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF INVENTION

1. Field of the Invention

The invention described herein relates to taxidermy wall mounts. More specifically, it relates to a mounting apparatus for an animal skull utilizing an improved mounting bracket and customizable support plate modeled after the natural features of the animal.

2. Description of the Prior Art

Perhaps the most difficult aspect of the game of hunting is selecting the style in which to display a prized animal. From wall mounts of varying size and style, to floor and desk/table mounts of the same, there exist numerous options to choose from.

When it comes to wall mounts, one such option is to use the "European" skull mounting system. European mounts exist where an animal skull, or replication thereof, is put on display free of all organic material. The skull can be displayed in this manner with or without the animals natural features attached. For those mounts utilizing the true skull of the animal, the head is first prepped by stripping it of its soft tissue layer, either by using flesh-eating insects or through boiling, followed by bleaching. For those desiring to display their prized animal's natural features in this style without dealing with the preparation of a real skull, a fake animal skull can be substituted. The natural features the hunter wishes to display, e.g., the antlers, are simply removed from the real skull and affixed to a replicated skull, and the setup appears similar to a true European mount.

Regardless of the display method chosen, the time will come when the mount is ready to be affixed to a vertical surface. This is accomplished through the use of a skull mounting bracket, which holds and secures the skull, connected to wall support plate which secures the entire mount to the vertical surface. There exist several shortcomings in both the skull mounting bracket and the support plate of the mounts available today that the present embodiment of the invention improves upon.

Firstly, given that that European mounting style is relatively recent to American taxidermy, there are few mounting methods available with a support system that does not involve drilling and screwing, gluing, or some other physical affixation of the skull to the mounting bracket. Sportsmen tend to shy away from this process as it essentially damages the skull. Moreover, when glue or fasteners are used, the skull becomes permanently attached to the mounting bracket making removal impossible. Sportsmen who wish to display the mount in its natural state (by something other than merely laying the trophy on a flat surface or stand) have very few options, as supporting an animal skull without altering it is complicated. Logically, support for an unaltered animal skull can be achieved through mimicking the way the base of the skull is supported naturally on the vertebrae.

The lower rear area of the skull, the occipital region, contains many natural formations designed to hold and articulate head at the atlanto-occipital joint, or the joint between the atlas, the topmost vertebra, and the occipital bone. These formations occur around a large oval passageway called the foramen magnum through which an extension of the spinal cord passes. Since these naturally occurring structures make up a region designed to support an animal's skull when it is alive, this seems an appropriate area to support the skull for display. The skull is naturally fastened in this area using muscles and tendons, but replicating this method would be akin to gluing the skull to the mount, which is undesirable as discussed previously. Therefore, employing the large and sturdy bone structure surrounding the foramen magnum as the primary support point offers the best option for mounting the skull in an unaltered manner.

Secondly, through a simple online search of taxidermy mounts one finds most mounting bases include a support plate of rather simple design: they are usually large, and a majority of them are made of wood and come in the shape of a shield. Alternatives to the generic plate designs are few, and most all of them add to the size, e.g. profile of the mount which can have the adverse effect of taking the viewers focus away from the animal. There are few choices available to sportsman who would like a skull mount with something other than a large, bulky support plates, or the small but all too common shield design.

There remains an absence in the above referenced materials, and in the art itself of a European skull mount utilizing a relatively simple, set-and-remove skull mounting system with the occipital region at the base of the skull as the support means, as well as a customizable support base that accentuates the mounted animal by using shapes more fitting to the art of taxidermy, such as the animal's natural features. These features include but are not limited to the skull's outer layers, including fur, skin, hair, wool, feathers, etc.; the antlers, horns, tusks, ears, and so on.

SUMMARY OF THE INVENTION

The present embodiment of the invention provides a European skull mount comprising a skull mounting bracket supplying the vertical support necessary to display the animal skull in its natural upright position on a vertical surface, while allowing for easy attachment and removal of the skull via a single pronged support that employs the foramen magnum at the base of the animals skull for mounting. The present embodiment also comprises a support plate with a "shadow-like" backdrop customizable to any of the animal's natural features the sportsman may wish to include. This not only gives the support plate for the mount the characteristic of appearing as nothing more than a shadow of the animal, as opposed to the large, and oftentimes out of place support plate designs of other mounts, but it allows for a multitude of options when choosing the mount style, as certain features can be left out of the plate if they are not wished to be displayed. Furthermore, the size or shape of plate can be increased to allow any of the incorporated features to be exaggerated. Other objectives not listed here can be ascertained from the description below.

DETAILED DESCRIPTION OF THE INVENTION

Figure 1:
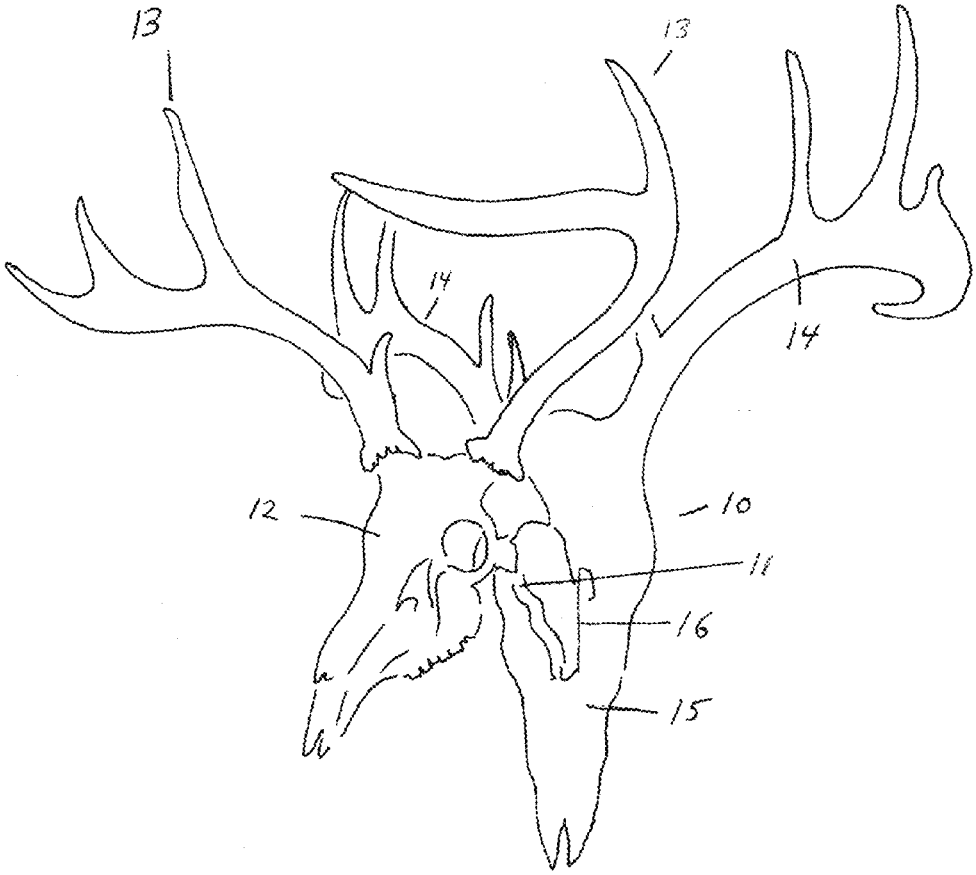
FIG. 1 is a perspective view of one preferred embodiment of the present invention.

Referring to FIG. 1, a first embodiment of the shadow mount of instant invention is shown for a white-tail deer, including a support plate 10 having a skull portion 15 in the shape matching that of the skull of the animal 12, and attached antler portions 14 in the shape resembling those of the antlers of the animal 13. The support plate 10 can be a one piece design or multiple pieces that are assembled. The preferred shadow skull mount is built in multiple pieces to allow the option of removing features to change the look of the mount when desired. The preferred method to manufacture the plate is to trace the animals skull, including any features wishing to appear as a shadow on the vertical surface to which the mount is affixed, determine the size of the shadow desired, and transfer the image to the plate material, finally cutting the shape using a laser cutter, plasma cutter, water jet, router, or by hand. The plate can be made from any type of material, including metal, wood, or plastic, with the preferred embodiment being 14 gauge sheet steel having a thickness of 1.905 mm (0.075"). The plate can be left unfinished, or it can be painted, varnished, stained, or fashioned in any way desired.

Still referring to FIG. 1, the support plate contains mounting means in its center for the attachment for the skull mounting bracket 16, which serves as the attachment point for the skull 12. Means for attachment of the shadow mount to a vertical surface, described in detail in subsequent figures, are accessible through the skull mounting bracket channel 11. In more detail, FIG. 1 shows the skull 12 being supported by the mounting bracket 16 such that the skull 12 and antler sections 13 of the animal are mounted central to the support plate skull 15 and antlers 14 components. Where the presented embodiment of the mount is assembled as described below, the plate 10 should appear as a shadow of the animal skull suspended before it.

The skull mounting bracket and support plate assembly details of the first embodiment of the present invention are dependent on orientation. To achieve an accurate shadow-like appearance, the plate is cut three percent (3%) larger than the animal skull. When the animal skull is mounted, the plate is partially hidden behind the animal skull when viewed head-on from the front, forming an even outline around the skull and features. It should be noted in other embodiments where the plate is cut to the same size as the skull and features, the plate will be obscured entirely by the mounted skull and features when viewed from the front. Furthermore, where features representative of the animal when it was alive are included in the plate, they will appear as a silhouette around the animal skull when viewed from the front.

Figure 2:
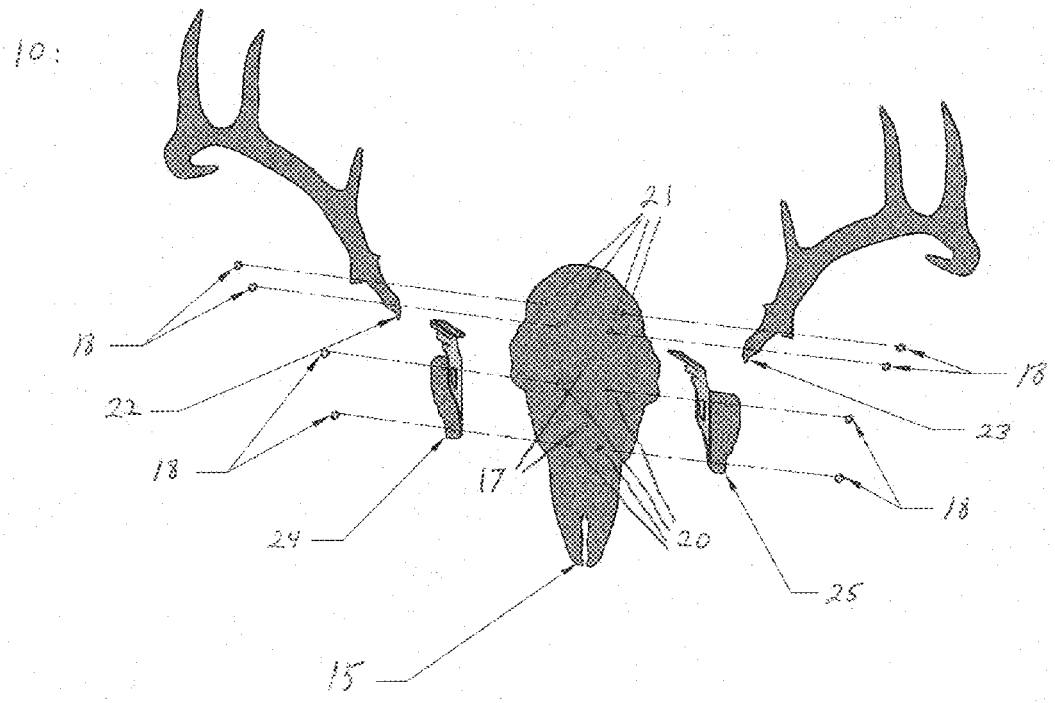
FIG. 2 is a perspective view of the embodiment shown in FIG. 1 illustrating how the mounting bracket and other components of the mount attach to the support plate.
Figure 11:
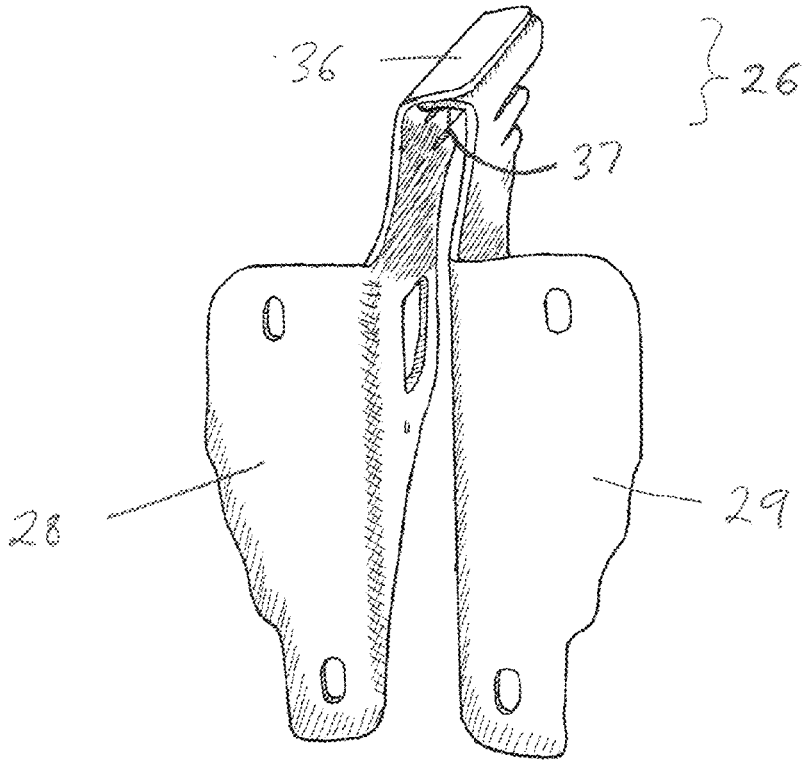
FIG. 11 is a rear perspective view of the mounting bracket shown in FIG. 7.
Figure 12:
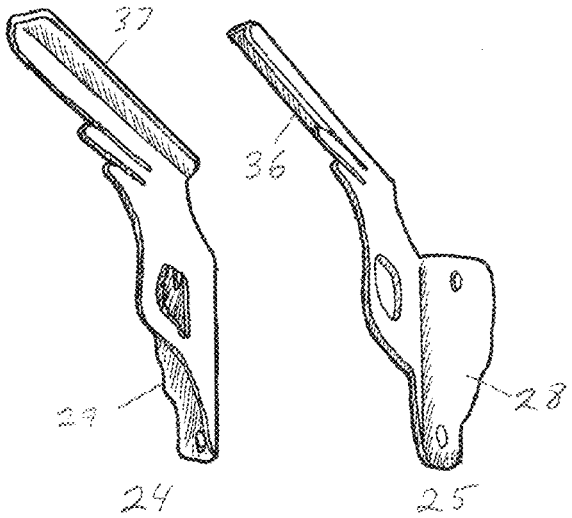
FIG. 12 is a perspective view of the two (2) mounting bracket halves.

Assembly of the support plate of the first embodiment of the present invention is best represented in FIG. 2, FIG. 11 and FIG. 12. In FIG. 2, mounting bracket 16 and support plate 10 from FIG. 1 are shown disassembled in perspective view and shaded to illustrate the intended shadow-like backdrop. Pictured are the skull portion 15, antler sections (14 of FIG. 1), with the left antler 22 and right antler 23 and the two (2) mounting bracket halves, a left portion 24 and a right portion 25. The support plate contains two (2) support plate mounting holes 17 located in the center. Also shown are the mounting stud sections 20 for the skull mounting bracket, and mounting stud sections 21 for the antler portions. The preferred embodiment contains mounting studs for animal features and skull mounting brackets that are 8/32 inch thread×5/8 inches long, with corresponding 8/32 inch acorn nuts. The mounting studs are through-mounted on the plate relative to how the animal skull and features will line up with their corresponding portions on the plate.

Figure 7:
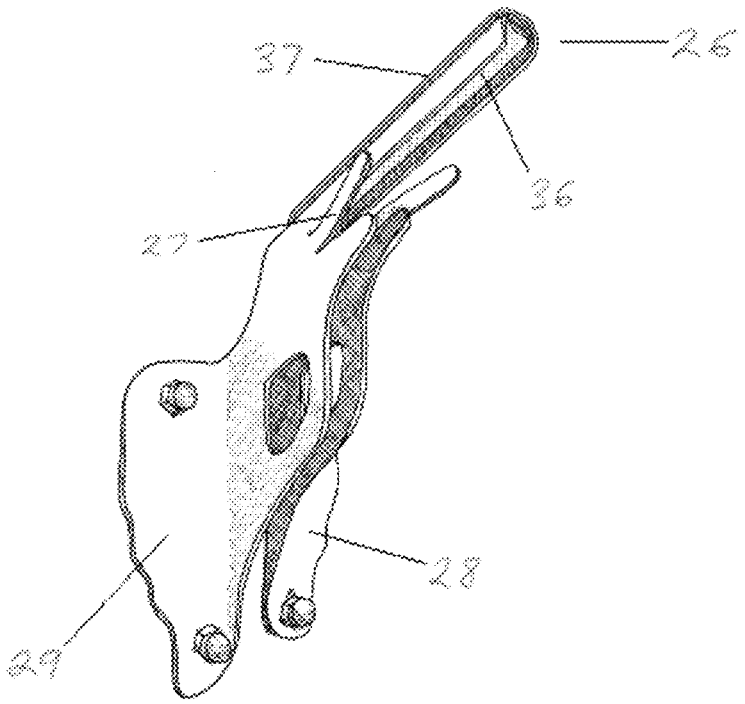
FIG. 7 is a left side perspective view of the mounting bracket of the preferred embodiment of the present invention, illustrating the adjustable stabilizing wings in an open position.

Next, FIG. 12 shows the two bracket halves 24 and 25. Holes are drilled in the rear planar portions 29 and 28 of the skull bracket halves 24 and 25, respectively, for orientation so that when the skull and bracket are combined and mounted vertically to the support plate, the features in the support plate skull portion line up in with the animal skull in accordance with the above. Assembly of the bracket halves is illustrated in both FIG. 11 and FIG. 12. In FIG. 12, the top planar portions of bracket half 24 and 25 are shown as 37 and 36 respectively. In this embodiment, when the two bracket halves join together on the mounting plate, one side of the top planar portion will rest atop the other side in forming the support prong 26. This is shown in FIG. 11, and FIG. 7, where the top planar portion 36 can be seen overlapping portion 37. Referring back to FIG. 2, the rear planar portion bracket tab holes are then placed over the studs 20 and secured to the support plate using acorn nuts 18. To complete the plate assembly, antler sections 22 and 23 are placed in their proper positions to line up with the antlers on the skull, and mounting holes are drilled in the base of the antler sections, which are then placed over the mounting studs 21 and secured to the support plate using acorn nuts 18. Note that this step may be omitted if the antler sections are wished to be left out of the finished mount.

Figure 3:
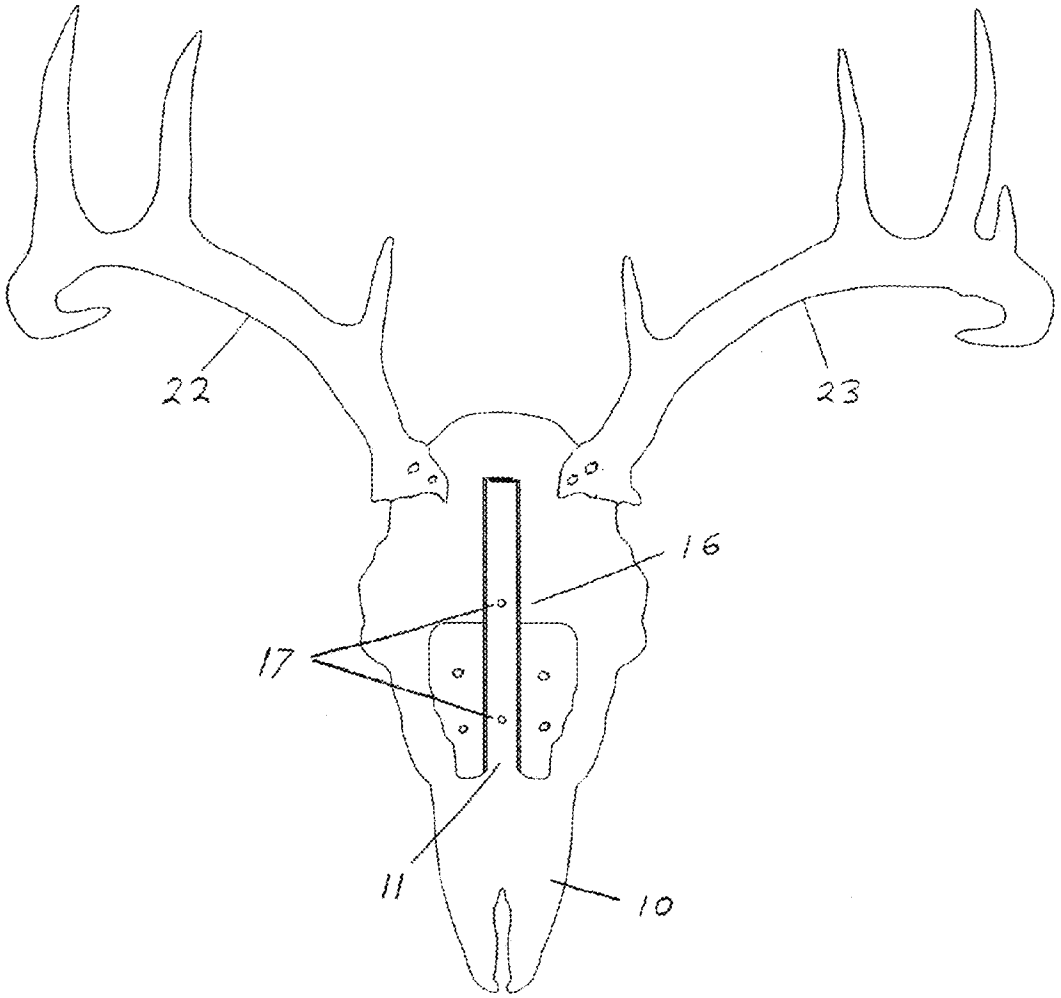
FIG. 3 is a front view of the embodiment shown in FIG. 1 illustrating the support plate with attached skull mounting bracket.
Figure 4:
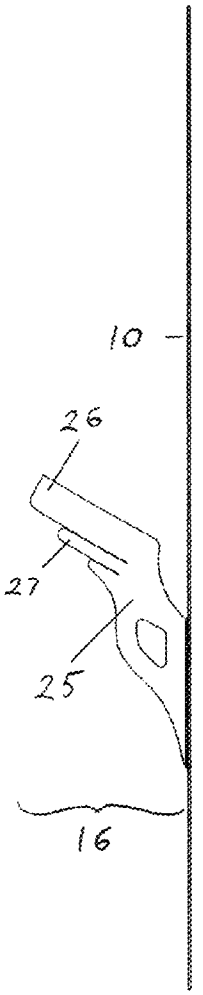
FIG. 4 is a right side view of the embodiment shown in FIG. 1, showing the details of the skull mounting bracket connected to the support plate.

FIG. 3 and FIG. 4 show alternate views of the first embodiment of the present invention in assembled form. Referring now to FIG. 3, the base plate 10 is seen in front view. Antler sections 22 and 23 are attached. The two skull bracket haves are assembled to form the skull mounting bracket 16. The open channel 11 exists between within the mounting bracket 16 permitting access to the support plate center mounting holes 17. The mounting holes 17 are used to secure the shadow mount to a vertical surface with screws, bolts, hooks, or any other standard mounting device. Though the plate center mounting holes 17 of the preferred embodiment are accessible with the skull mounting bracket attached, the support plate should be mounted on the vertical surface before attachment of the mounting bracket.

Figure 5:
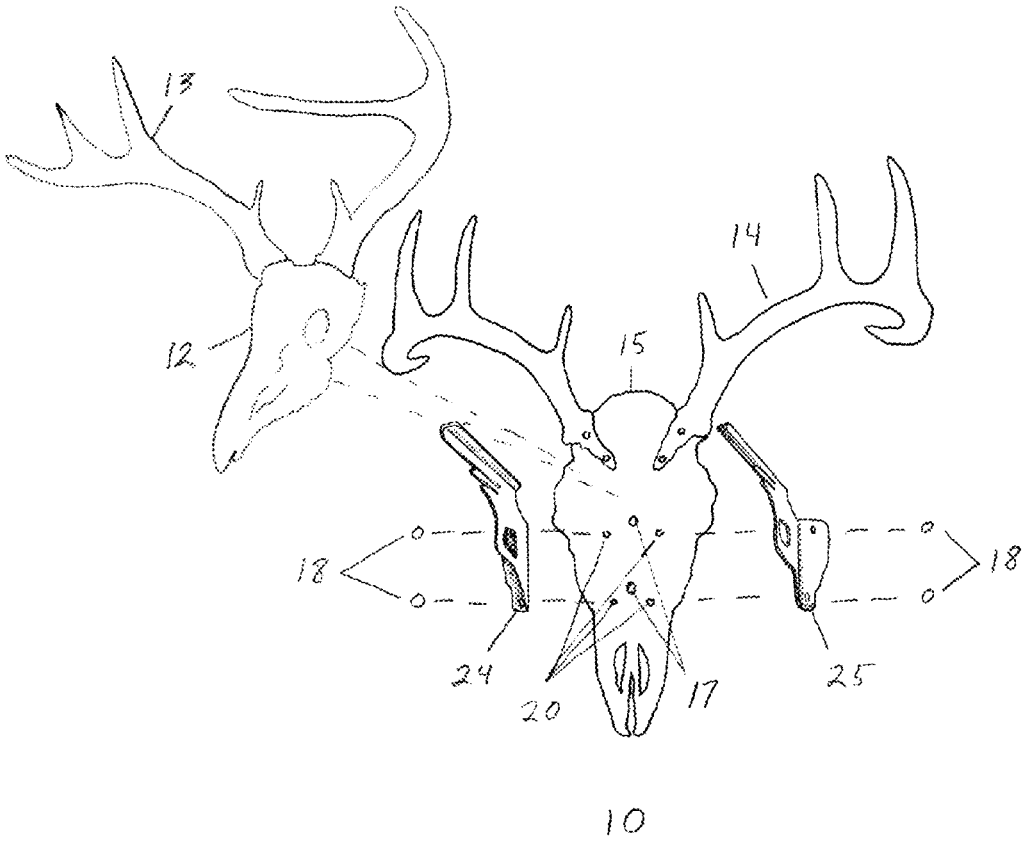
FIG. 5 is a perspective view of the embodiment shown in FIG. 1 illustrating how the mounting bracket is assembled, and how the mounting bracket receives the skull.
Figure 6:
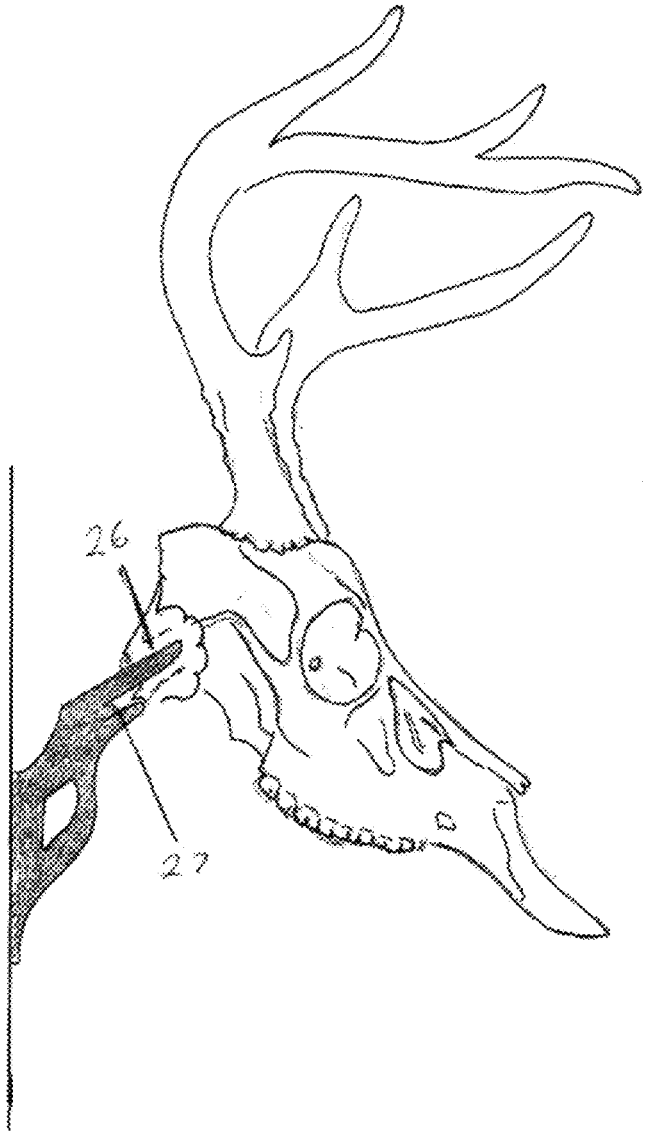
FIG. 6 is a left side, partial cutaway view of the embodiment shown in FIG. 1, showing how the skull mounting bracket supports the skull.

Placement of the animal skull on the present embodiment of the invention is best represented in FIG. 4, FIG. 5 and FIG. 6. As previously discussed, and reiterated in FIG. 5, the skull mounting bracket left side 24 and right side 25 are attached over the mounting studs 20 and secured to the support plate with acorn nuts 18. When assembled, the skull mounting bracket will form a one piece prong for mounting the animal skull 12. In the preferred embodiment of the invention, the skull is to rest on the mounting bracket far enough forward such that neither the skull, nor any of its features will touch the base support plate when affixed to a vertical surface.

The preferred embodiment allows for full support of the animal skull in a natural, upright and forward-looking position with minimal adjustment. Referring now to FIG. 4, a right side view of the first embodiment of the invention is shown illustrating the mounting characteristics of the skull mounting bracket 25 in detail. The large support prong 26 is designed to fill a significant portion of the Foramen magnum of the animal skull when said skull is placed over the mounting bracket. As shown in the cutaway portion of FIG. 6, the shaded mounting bracket large support prong 26 seats itself within the base of the animal skull and support is provided through cantilever action of the skull on the support prong. When the skull is set on the mount, the weight of the nose region will cantilever the skull forwards, and the interior portion of the foramen magnum will rest against the top of the large support prong 26 to hold the skull in place. The size of the support prong provides a large contact area against the top, ovular portion of the foramen magnum to secure the skull, eliminating the need for additional support means.

Figure 8:
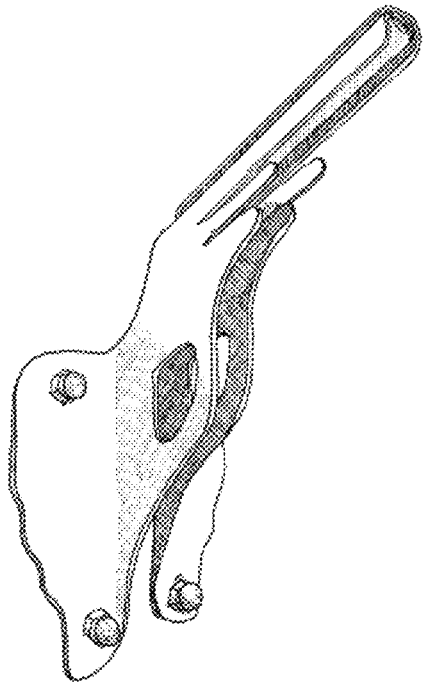
FIG. 8 is a left side perspective view of the mounting bracket shown in FIG. 7 with the adjustable stabilizing wings in a closed position.

Should the animal skull require straightening, or additional fixing to prevent it from twisting on the mount, the support bracket of the first embodiment of the invention contains two (2) adjustable stabilizing wings, shown as 27 in FIG. 4, FIG. 6, and FIG. 7. The stabilizing wings 27 can be bent outward to contact the outside of the foramen magnum, or any other area of the occipital region to hold the skull in the proper position. Note that the stabilizing wings are not intended to, nor do they provide any meaningful structural support; their purpose is to merely straighten, or keep the skull straight on the mount. For illustration of how the stabilizing wings of the support prong operate, FIG. 7 illustrates the mounting bracket of the preferred embodiment of the invention with the stabilizing wings bent outward thirty (30) degrees. Referring now to FIG. 8, the same mounting bracket is shown with the stabilizing wings retracted in the standard support position. The stabilizing wings simply bend outwards from the support prong into any angled position desired.

Figure 9:
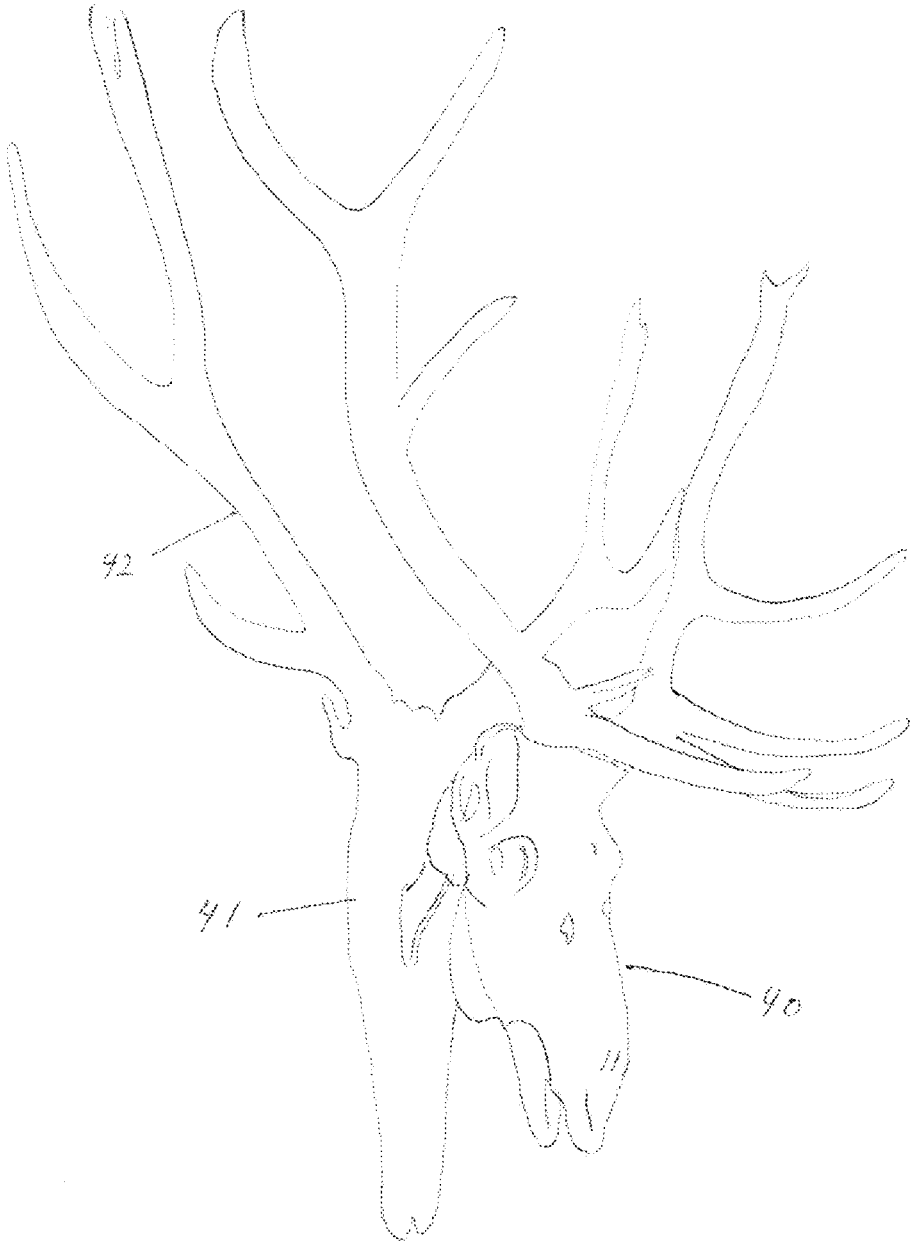
FIG. 9 is a perspective view of a second embodiment of the present invention where the skull mounting bracket is attached to a support plate with antler portions shaped after an Elk.

In its broadest form, the invention provides for a European style mount that emphasizes an animal's natural features by incorporating them into the design of the base plate, which gives the appearance the mount is casting a shadow against the surface to which it is attached. There are a multitude of animals the present invention can be used to mount, with each animal providing a variety of features that can be included in the base plate design. This is where the advantages of this invention become apparent. For instance, FIG. 9 is a second embodiment of the shadow mount for an elk. FIG. 9 shows an enlarged support plate 41 to accommodate the larger skull of the animal 40, as well as larger and more upright antler sections 42. Though not shown in FIG. 9, the antler sections 42 may be removed from the support plate 41 if desired.

Figure 10:
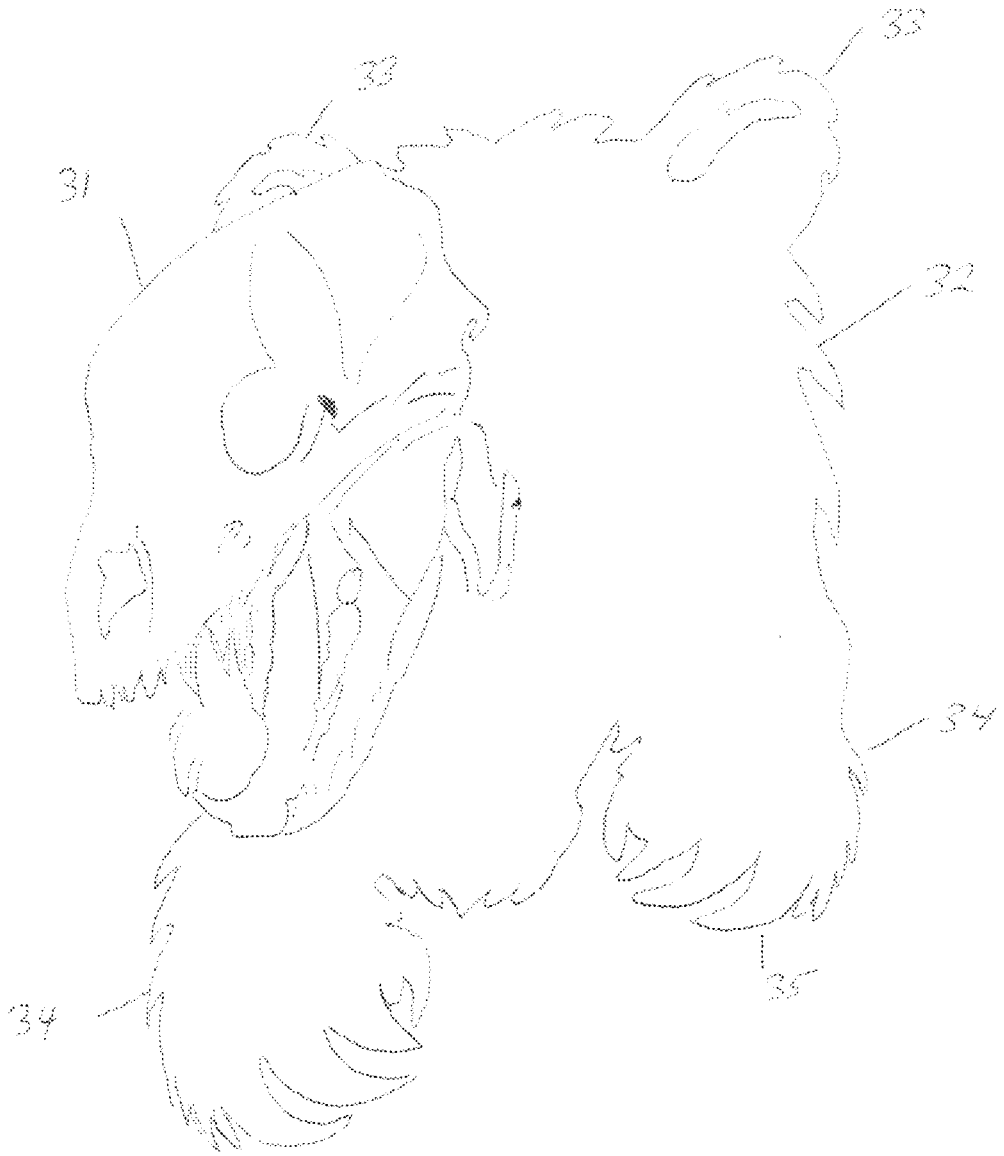
FIG. 10 is a perspective view of a third embodiment of the present invention where the skull mounting bracket is attached to a support plate modeled after a bear.

FIG. 10 illustrates a third embodiment of the shadow skull mount crafted for a bear. The embodiment illustrated by this mount is unique in that the skull 31 is oriented on the support plate 32 such that the plate appears as a silhouette of the original features the bear possessed when it was alive. These features are represented in FIG. 10 as the ears 33, arms 34, claws 35, and coat of fur, illustrated by the jagged edge surrounding the plate.

The preferred and most recognizable embodiment of the present invention has been described in detail, and will allow those familiar with the art to make and use the invention. While several other illustrations and suggestions are provided herein, the present invention is not to be limited solely to what has been described and shown above, but is to include all skull mounting devices that fall within the scope of the invention.

We claim:

1. A trophy mount, comprising:

a base support plate containing means for securing said plate to a vertical surface;

a two-piece skull mounting bracket having a right half and a left half, with each half possessing a first end and a second end connected by a support section, whereby the first end of each half contains a short planar portion which joins together with the other half to form a single outwardly extending support prong sized to fit into the foramen magnum of an animal skull and support the skull, without fasteners, in an upright, natural position for display;

wherein the skull mounting bracket contains a pair of stabilizing wings cut into the support section, located just under and slightly rearward to the planar portions of the first end of each piece of the bracket such that the wings are adjacent to the support prong when the pieces are joined together, which can be bent outward to contact the rear of the animal skull for adjustment of the skull on the mount;

wherein said second ends of each piece of the mounting bracket are bent ninety (90) degrees, perpendicular to the support section, so the second ends run planar to the base support plate;

wherein the planar portions of the second ends of each piece are configured to be attached to the base support plate such that the support prong formed by the first ends extends outward and upward at an angle from said base support plate to accept a skull and present it central to the support plate when viewed from the font such that the support plate appears as a silhouette of an animal when the mount is affixed to a vertical surface.

2. The trophy mount of claim 1, wherein said base support plate further includes means to attach separate features comprising one or more steel plates having the general appearance of common game animal traits not already incorporated into the support plate.

3. The trophy mount of clam 2, where said separate features appearance is selected from the group consisting of antlers, horns or tusks.

* * * * *